US006413364B1

(12) United States Patent
Sandison

(10) Patent No.: US 6,413,364 B1
(45) Date of Patent: Jul. 2, 2002

(54) METHOD, FOR THE RECOVERY OF WOOD FIBER FROM COMPRESSED FIBERBOARD SCRAP

(75) Inventor: Malcolm Sandison, Grange House, 19 School Lane, Sewstern, Grantham, Lincolnshire, NG33 5RL (GB)

(73) Assignees: Malcolm Sandison; Alan Thorpe, both of Grantham (GB)

( * ) Notice: Subject to any disclaimer, the term of this patent is extended or adjusted under 35 U.S.C. 154(b) by 0 days.

(21) Appl. No.: 09/743,055

(22) PCT Filed: Mar. 8, 1999

(86) PCT No.: PCT/GB99/00690

§ 371 (c)(1),
(2), (4) Date: Jan. 3, 2001

(87) PCT Pub. No.: WO00/01877

PCT Pub. Date: Jan. 13, 2000

(30) Foreign Application Priority Data

Jul. 3, 1998 (GB) ..... 9814358

(51) Int. Cl.[7] ..... D21B 1/32; D21B 1/36

(52) U.S. Cl. ..... 162/4; 162/5; 241/21; 241/23; 241/28

(58) Field of Search ..... 162/4, 5, 21, 55; 241/17, 18, 21, 23, 28; 210/612, 631

(56) References Cited

U.S. PATENT DOCUMENTS

| | | | | |
|---|---|---|---|---|
| 4,188,259 A | * | 2/1980 | Mamers et al. | 162/4 |
| 4,930,230 A | | 6/1990 | Weckherlen et al. | 34/168 |
| 4,974,781 A | * | 12/1990 | Placzek | 241/17 |
| 5,316,621 A | * | 5/1994 | Kitao et al. | 162/4 |
| 5,358,185 A | | 10/1994 | Konecsny | 241/18 |

FOREIGN PATENT DOCUMENTS

| | | |
|---|---|---|
| EP | 0 062988 | 10/1982 |

* cited by examiner

*Primary Examiner*—Dean T. Nguyen
(74) *Attorney, Agent, or Firm*—Harrison & Egbert

(57) ABSTRACT

The invention provides a process and apparatus for the treatment and recovery of fiberboard and particle board waste. Waste fiberboard and particle board is fed into a steam chamber and steam treated with steam under pressure from a steam generator. When the steam treatment is completed any effluent and excess steam are evacuated from the chamber and the steam treated waste is passed through a rotating trommel. Woodfibers and woodchips pass through the screens of the trommel and are collected for drying and further processing. Waste material, such as melamine coatings, passes through the trommel for collection and disposal. The collected woodfiber and woodchips can be processed for reuse in paper, cardboard or particle board manufacture or as mulch and other ground cover material.

11 Claims, 3 Drawing Sheets

METHOD, FOR THE RECOVERY OF WOOD FIBER FROM COMPRESSED FIBERBOARD SCRAP

BACKGROUND OF THE INVENTION

This invention relates to the recovery of wood fibre from fibreboard, including M.D.F. (Medium Density Fibreboard), chipboard, particle board, hardboard, and the like fibre-based board, (hereinafter referred to generically as "compressed fibreboard").

DESCRIPTION OF RELATED ART

Particle board, commonly called wood chipboard in the UK, is made from small chips or particles of wood coated with a synthetic resin glue (normally urea-formaldehyde) and pressed into sheets.

From the mid 1940's chipboard revolutionized the furniture industry, in that it made it possible for furniture to be made from a large flat panel without joints. At the present day, almost all manufactured furniture utilizes chipboard in place of natural wood and because of the suitability of chipboard to have melamine, decorative paper veneers and postform worktops applied in the factory, a massive industry has been created.

With the introduction of Medium Density Fibreboard (M.D.F.) in the 1970's, the necessity to cover the edges of the board was overcome. Furniture makers found they could now rout the edges so their pieces looked like furniture manufactured from solid wood. M.D.F. is an ideal substrate for machining and finishing. Modem use of this material is now extended even to, the production of architraves and wall skirting used in most houses built today.

It is estimated that the total consumption figure for the UK is around 2.5 million cubic meters of chipboard products and around 0.5 million cubic meters of M.D.F. products per year. At an average density of 750 kg/cubic meter this represents an annual consumption of around 3.75 million tonnes. Similar consumption figures would also apply to each of the major European Countries.

Even at this time of cost conscious production methods, utilizing computer controlled cutting and profiling machinery, an average furniture manufacturer will waste in the region of 5% of the raw materials used. Such wastage is in the form of off-cuts, trimmings, spoiled panels and dust produced in the sawing and milling operations. On the basis of this, the total amount of such waste material entering the UK waste stream is at least 350,000 tonnes per year.

Major difficulties have however been encountered in the recovery of processed wood products such as chipboard and M.D.F. Such waste material contains around 8% urea-formaldehyde resin and is often covered with a bonded melamine or paper veneer. Thus the use of conventional recovery equipment such as shredders or chippers is not practical since the additional items such as the decorative coating would contaminate the potential recovered product. Further difficulties exist if such recovered material is used for animal bedding, through possible respiratory problems associated with the fine dust and the formaldehyde content.

Further, conventional shredding equipment only shreds the material, thus the in-line grain chips, demanded by the end user for chipboard or paper uses, would be torn and rendered useless.

A small proportion of the M.D.F. and chipboard waste is, nonetheless, used in the animal bedding market and a small proportion is also used as a Waste to Energy fuel. However, at the present time most of the chipboard and M.D.F. waste generated by the furniture industry in the UK enters the general controlled waste stream which is predominantly directed to landfill disposal. The cost of such landfill disposal has increased dramatically in recent years and is expected to increase further.

In contemplating any feasible and cost effective method that could be utilized to recover the fibrous content of such wood based products, it is important to understand the methods of the manufacture of both chipboard and M.D.F. Production of both chipboard and M.D.F. involves the use of a synthetic resin binder and adhesive. The synthetic resin glue normally used in both particle board and M.D.F. production is a urea-formaldehyde solution containing a small proportion of paraffin wax.

Chips of wood are coated with the resin and a matt of coated wood chips is formed on a stainless steel caul or platen which is then fed to a heavy duty press. The rate of closure of the press as well as the actual pressure and controlled high temperature applied influence both the physical and mechanical properties of the finished board.

In the case of the production of M.D.F., the wood fibres are coated with urea-formaldehyde resin after a defibration process and similarly pressed into aboard, but at much higher pressure and increased thickness of the fibrous matt, to achieve the extremely high density required for the finished board material.

An alternative method of manufacture can be used for the production of hardboard and some fibreboards. In this method, the board is made without the use of a resin adhesive and the manufacture relies on the ligno-cellulosic quality of the wood fibre. The basic strength and adhesion is obtained from the felting together of the fibres themselves and from their own adhesive properties.

An object of the invention is to provide a process and apparatus for treating waste fibreboard to enable the wood fibre thereof to be recycled.

A further object of the invention is to enable the separation of NI.D.F. and chipboard into their various components, i.e. woodfibres, resin and coatings, without destroying or deforming the actual fibres or contaminating the recovered fibre with melamine or other coatings. According to this invention there is provided a method of recovering wood fibres from compressed fibreboard scrap, involving the steps a) admitting the scrap into a container;

b) subjecting the scrap in the container to steam;

c) screening the scrap to separate wood fibres from the remainder of the scrap.

Preferably waste material is treated without pre-processing. Waste in the form of off-cuts, trimmings, spoiled panels etc. may be steam treated as received from the furniture manufacturers or other suppliers.

Preferably the scrap is agitated in the container while being subjected to steam. By so agitating the scrap, preferably gently, the scrap opens up, allowing steam to penetrate into the interior of the pieces of scrap, removing the adhesives such as urea-formaldehyde, without any significant damage to the wood fibres.

The action of the steam on the fibreboard breaks down the resin binding agent which then forms a liquid effluent. Advantageously this is drained off and can be recycled for use again. By using the steam treatment of the waste, the quantity of effluent liquid produced is low in proportion to the volume of material treated.

Preferably the steam contains additives such as wetting agents.

Preferably the steam treatment is carried out under pressure. Advantageously an increase in pressure over atmospheric pressure of greater than 1 p.s.i., preferably in the range of 3 to 10 p.s.i. is used. Although in certain circumstances a higher pressure may be utilized. Advantageously the steam treatment is carried out for at least 30 minutes.

Preferably liquid effluent is extracted from the chamber during the steam treatment process. Alternatively the liquid effluent may be extracted at the end of the steam treatment. Advantageously any excess steam and fumes are extracted from the steam chamber at the end of the steam treatment. This ensures that no fumes are emitted during operation and that, once the steam treatment is completed, the environment in the steam chamber will be safe.

Preferably subsequent to the subjection of the scrap to steam under a pressure greater than atmospheric pressure, the scrap is subjected to a low pressure, preferably at least 1 p.s.i. less than atmospheric pressure, preferably in the range of 3 to 10 p.s.i. less than atmospheric pressure, although in certain circumstances, particularly where certain types of phenolic resin are used, a lower pressure may be desirable.

Preferably the scrap is agitated while being subjected to said low pressure.

Such application to the scrap of low pressure carries out two major functions, the first being that the break-up of the scrap material is increased, as the pieces of scrap tend to further expand under the action of the low pressure. Again this preferably aided by the continuous agitation of the scrap within the container exposing the interior of the scrap and separating the chips from surface decoration of the scrap, such as melamine.

The second function of the low pressure is that it allows fumes to be withdrawn from the container, so that noxious components thereof may be removed, such as by scrubbing.

If desired scrap may be subjected to repeated steam pressure and low pressure treatment stages, conveniently said stages under these circumstances being of shorter duration.

Preferably the method involves transferring the treated scrap from the container to a screening device, conveniently afforded by a rotary trommel.

Advantageously the rotating action of the trommel breaks the steam treated waste pieces down. The separated woodfibre and/or woodchips pass through appropriate mesh gauges of screen and are then collected and any material such as melamine, Formica etc. that is not broken down bypasses the screen plates and is fed out for collection in a suitable receptacle.

Preferably the trommel pass rate is slow enough to enable the steam treated waste pieces to be sufficiently broken down by the rotating action of the trommel.

Preferably the process of the invention comprises the further step of drying the collected woodfibre and/or woodchips.

Preferably the process comprises the further step of processing the collected woodfibre and/or woodchips for re-use.

Preferably the woodfibre is further processed for use in paper, cardboard or board manufacturing.

Preferably the woodchips are further processed, for example by defibration, for use in paper manufacturing. Alternatively, the woodchips may be further processed for use in chipboard.

According to this invention there is provided an apparatus for the recovery of wood fibre from compressed fibreboard scrap comprising a) a container wherein the scrap may be loaded;

b) a steam generator to apply steam to the container; and c) means to agitate the scrap in the container while steam is applied thereto.

Preferably the container is afforded by a drum, and said means to agitate the scrap in the container comprises means to rotate the drum, conveniently for short periods in opposite directions.

Advantageously the means to agitate the scrap in, the container also comprises vanes or ribs mounted in the container, such as extending helically within the container to "tumble" the scrap within the container as the container rotates.

Preferably the container is mounted within a sealed vessel comprising inlet means for the admission of steam, and outlet means for the withdrawal of moisture from the container.

Preferably the steam chamber is fitted with a liquid drainage sump in the base. Preferably the apparatus comprises extraction means connected to the top of the steam chamber and operative, upon the completion of a steaming cycle, to evacuate excess steam and any liquid prior to the opening of the chamber doors. Alternatively the steam and fume evacuation may be carried out by a separate evacuation system.

Sealing of the chamber and evacuation at completion of the steam cycle ensures that no fumes are emitted during operation and that, once opened, the chamber environment will be safe.

According to this invention there is also provided a waste recovery plant comprising apparatus as set out above, and screening apparatus to which treated scrap is fed from the container.

Preferably the screening apparatus comprises a rotary trommel screen. Advantageously the rotary trommel screen can be fitted with different screening surfaces and different size screen meshes. Alternatively, the screening may be carried out by the use of a vibrating table-type machine.

Preferably the plant further comprises drying means to dry the collected woodfibre and/or woodchips. Advantageously the drying means comprises a drying chamber.

Preferably the plant further comprises processing means to refine the collected woodfibre and/or woodchips. In one embodiment, the processing means may comprise a defibration plant to treat recovered woodfibre for use in the paper making industry.

BRIEF DESCRIPTION OF THE SEVERAL VIEWS OF THE DRAWINGS

The invention will now be described, by way of example only, with reference to the drawings

DETAILED DESCRIPTION OF THE INVENTION

Figure 1:
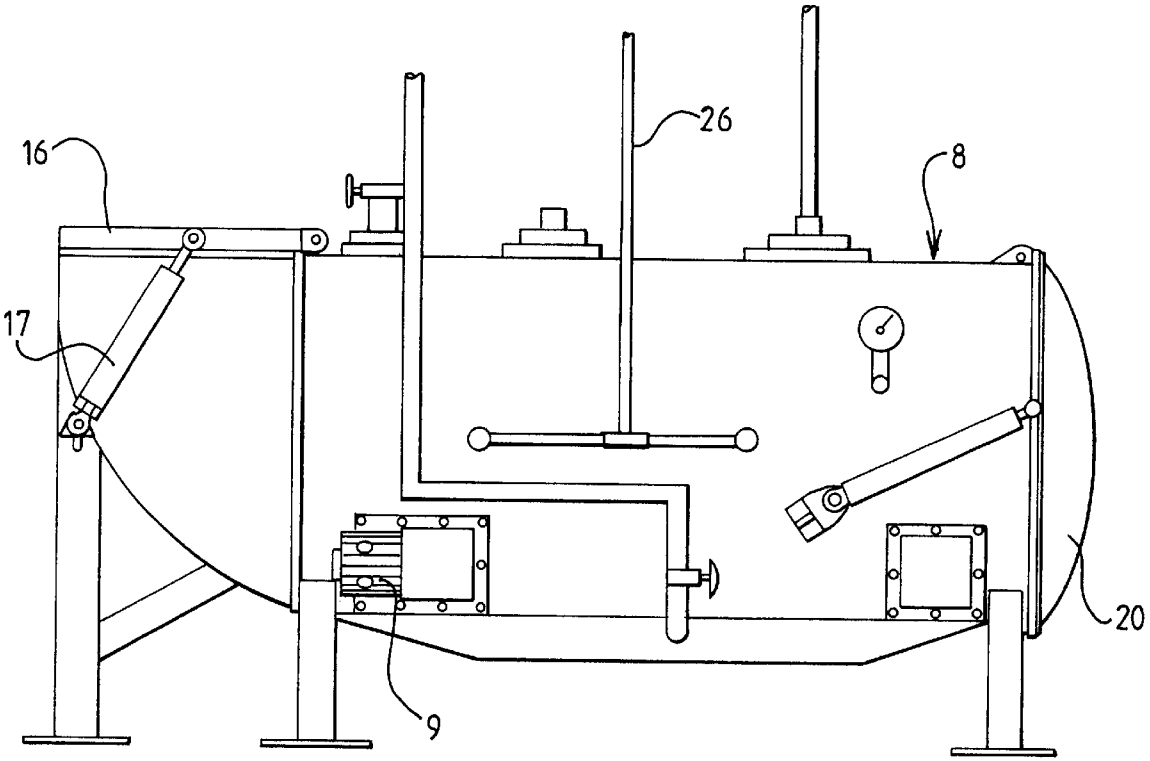
FIG. 1 is a side elevational view and FIG. 2 an end elevational view of an apparatus which is a preferred embodiment of this invention.
Figure 2:
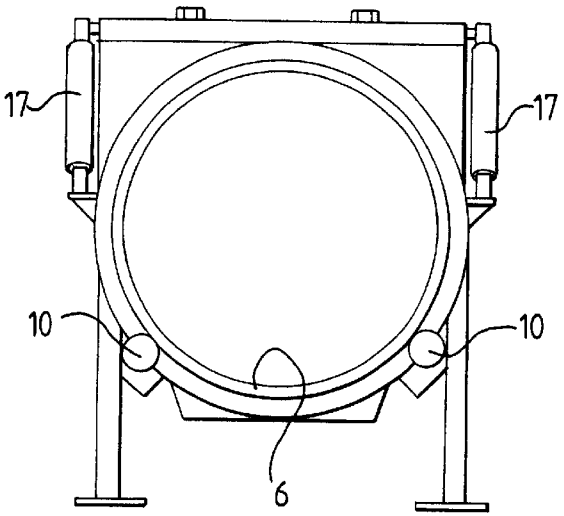
Figure 3:
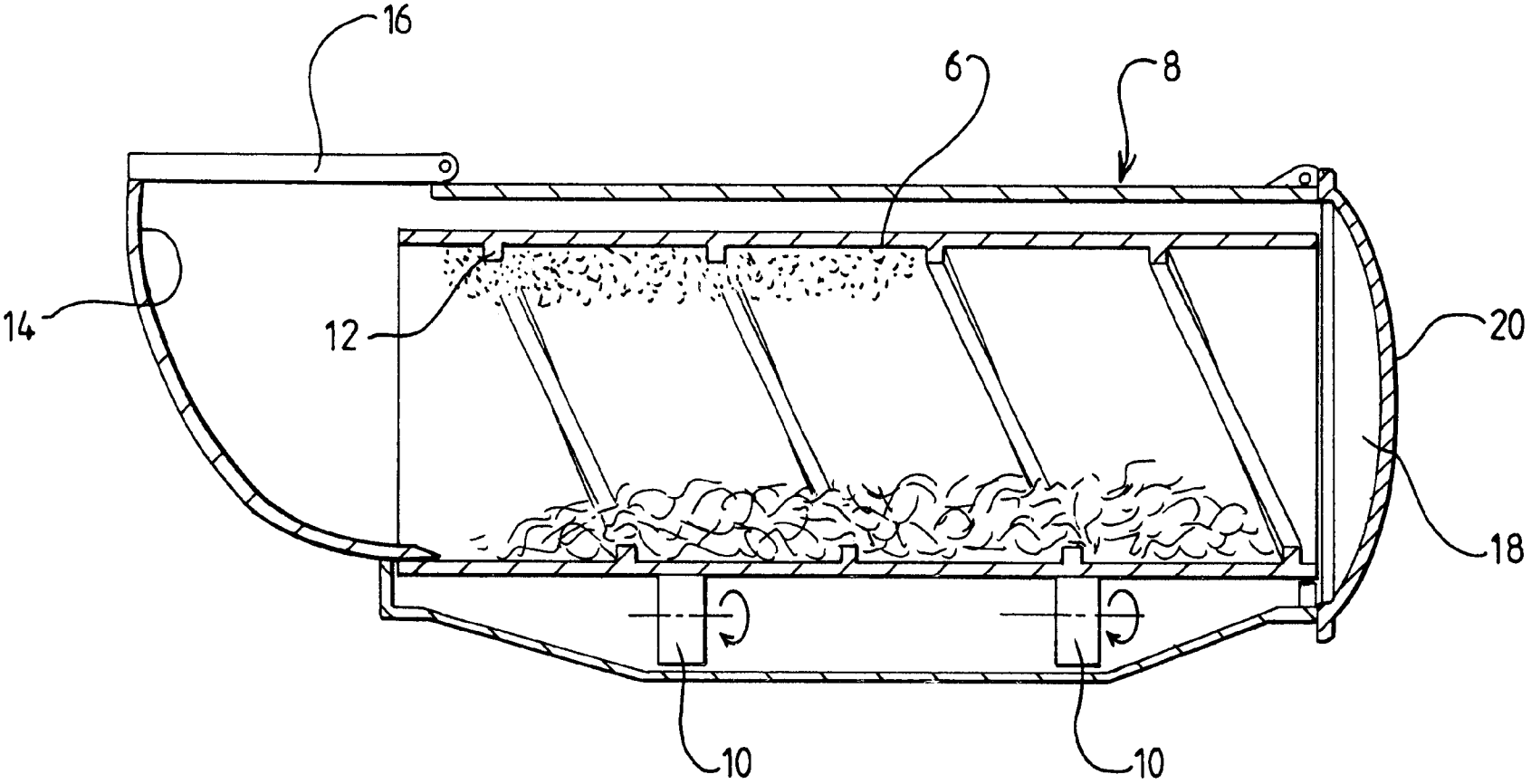
FIG. 3 is a sectional view of the apparatus.

The apparatus which is the preferred embodiment of this invention comprises a generally cylindrical, open-ended container 6 conveniently fabricated from perforated stainless steel sheet, mounted in a pressure vessel 8. Drive means in the form of rollers 10 are located in the base of the pressure vessel 8, on which rollers 10 the container rests, and by rotation of the rollers 10, the container may be caused to rotate about its longitudinal axis (see FIG. 3).

Provided on the interior cylindrical wall of the container 6 one or more helical ribs or vanes 12 are located.

The pressure vessel 8 is provided with an inlet 14, across which a door 16 is mounted, clamping means (not shown) being provided to retain the door 16 in its closed position.

The pressure vessel 8 is also provided with an outlet 18, across which a door 20 is similarly mounted.

In the preferred embodiment the inlet 14 lies in a generally horizontal plane, while the outlet 18 lies in a generally vertical plane.

The apparatus comprises a steam generator 24 from which pipes 26 extend into the pressure vessel 8, for the admission of steam to the interior of the pressure vessel, and thus to the container 6.

The apparatus also comprises extraction means 30 by which air may be withdrawn from the pressure vessel 8, to produce within the vessel 8 a pressure less than atmospheric, as will be explained hereinafter.

The apparatus also comprises drainage means 34 by which liquid accumulating beneath the container 6 may be withdrawn from the pressure vessel 8.

Figure 4:
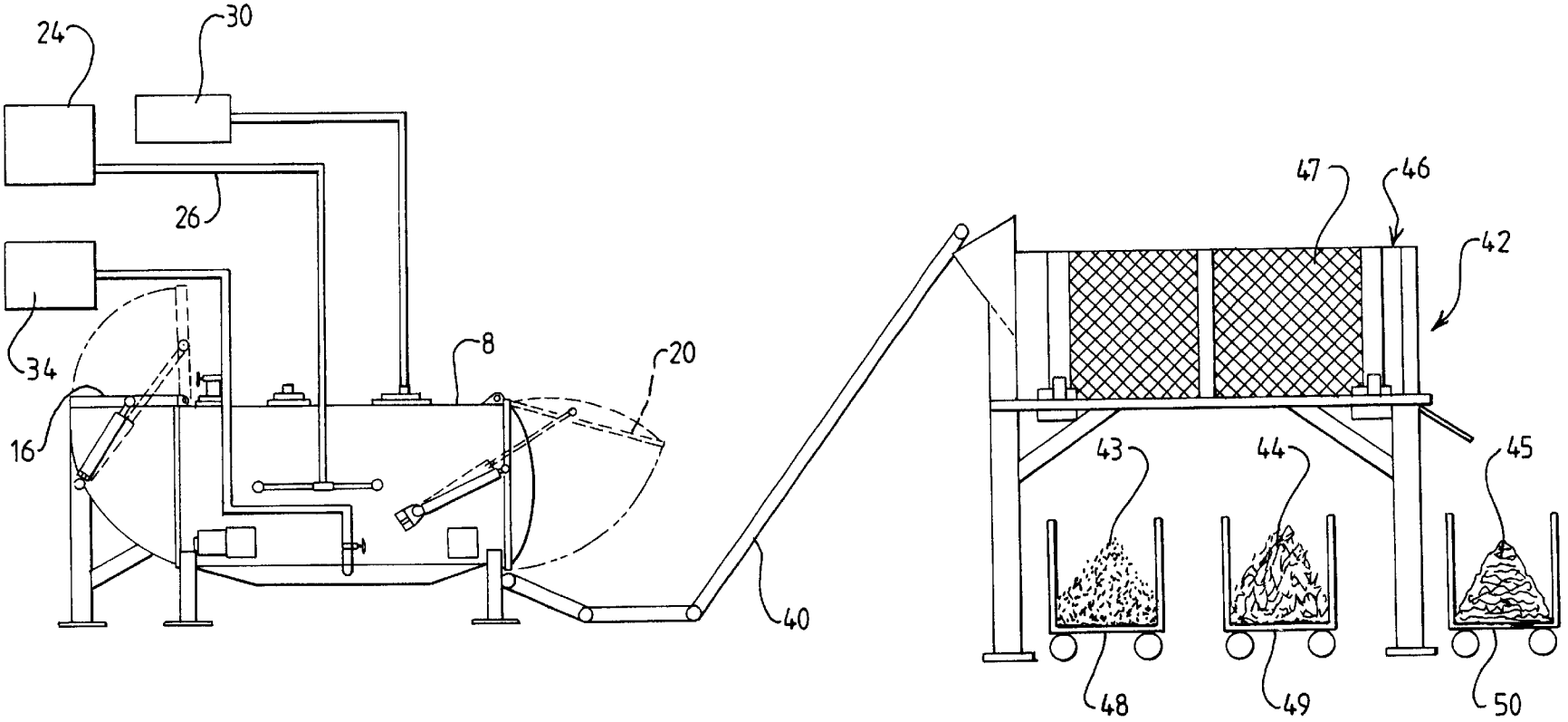
FIG. 4 is a side elevational view of a treatment plant incorporating the apparatus, said treatment plant also being illustrative of the invention in certain of its aspects.

In the use of the apparatus which is the preferred embodiment of this invention, the door 16 is opened by power means (the open position being shown in dotted lines in FIG. 4), and compressed fibreboard scrap introduced through the inlet into the pressure vessel 8. The scrap material will usually be in the form of off-cuts, trimmings and spoiled panels from furniture manufacturers, but may also include separate chipboard and M.D.F. elements from ex-consumer furniture items. The waste material may comprise other processed wood products, and other wood fibreboard waste, such as insulating board, standard hardboard and medium density boards.

When a desired quantity of scrap material has been introduced into the pressure vessel, the door 16 is closed by the power means 17, the door 20 at this stage also being closed. The drive rollers 10 are rotated by the drive motors 9, to cause the container 6 to rotate slowly about its longitudinal axis. The helical ribs 12 will cause the scrap material to be picked up and fed slowly into the rotating container, towards the outlet 18.

The steam generator 24 is at this time operated, to inject steam into the pressure vessel 8, the steam flowing into the container 6 and acting on the scrap material as it is agitated (slowly tumbled) within the container 6.

Conveniently after rotation by the drive motors. 9 for a short period of time in one direction, the direction of rotation of the container 6 may be reversed, to prevent the scrap material from accumulating at one end of the apparatus.

Advantageously the steam generator is operative to produce a steam pressure within the pressure vessel 8 in excess of atmospheric, of a least 1 p.s.i. above atmospheric pressure, preferably about 5 p.s.i.

After treatment of the scrap material for perhaps 30 minutes, during which time surplus condensate may be withdrawn from the pressure vessel 8 by the drainage means, supply of steam is terminated, and air is withdrawn from the pressure vessel 8 by the extraction means 30, conveniently operative to reduce the pressure within the vessel 8 to slightly below atmospheric pressure, conveniently about 5 p.s.i. less than atmospheric pressure. During this time rotation of the container 6 by the drive rollers 10 is continued.

The effect of the extraction means 30 is to reduce the moisture content of the scrap material within the pressure vessel 8, and also to "open" the interior of the pieces of scrap material, caused by the low pressure.

Extraction of air and moisture from the vessel 8 by the extraction means 30 is continued until sufficient fumes have been extracted from the system to make it safe to open the door 20.

If desired treated scrap material may be ejected from the pressure vessel by continued rotation of the container 6 in its forward direction, scrap material is ejected from the outlet 18 onto a conveyor 40, operative to transfer the treated scrap material to a screening means (see FIG. 4) in the form of a rotary trommel 42. If desired, however, the container 6 may be mounted for tilting movement, conveniently by pneumatic rams.

The trommel 42 comprises a rotating drum 46 fitted with integral screens 47. The screens 47 are selected to have an appropriate mesh to allow the woodfibre 43 and woodchips 44 to pass through into respective receptacles 48,49 and for the coating sheets of melamine, Formica and other waste 45 to continue out of the end of the trommel 42 for collection in a container 50. The mounting angle of the trommel 42 can be adjusted to create a slow or fast pass and flow of material. For optimum processing of the steam treated waste, a comparatively slow pass rate is desirable. The separated woodfibre 43 and woodchips 44 pass through the appropriate mesh in the screens 47 and are collected under the trommel 42 in the receptacles 48 and 49. The separated woodfibre 43 and woodchips 44 are then dried in a drying unit and passed for further processing.

The apparatus and process of the invention normally requires no pre-crusher, hammermill or shredder to break the waste up before treatment.

Once the waste has been treated and the woodchips and woodfibre have been recovered, they can be recycled for use in many end products. For example, woodfibre can be chemically treated for use in manufacturing paper and it can also be reused in the production of fibreboard and cardboard. Recovered woodchips can also be used in producing paper pulp and the process may include the defibration of the recovered woodchips for this end use. Woodchips may also be reused in the production of chipboard, or used in horticulture as mulch or ground cover and as a safety surface in children's playgrounds. A further possible use is as an all weather surface for horse running tracks and courses in place of the presently used granulated rubber.

A proportion of the recovered waste may also be used as a fuel source within the processing plant if desired. This may be in the form of compressed briquettes of fine M.D.F. sawdust, which is normally non-recoverable and difficult and expensive to landfill.

The process and apparatus of the invention have the advantage that they are suitable for the recovery of large volumes of waste chipboard and M.D.F. material in off-cut and panel form as generated within the furniture and related industries and which are currently disposed of at high cost in landfill sites. The process and apparatus of the invention can also be used for ex-consumer furniture items if these are segregated into chipboard and M.D.F. form.

The process and apparatus of the invention acts to effectively render the waste fibreboard and M.D.F. back to their constituent parts for effective recycling.

The features disclosed in the foregoing, description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

What is claimed is:

1. A method of recovering wood fibers from compressed fiberboard scrap comprising:

admitting the compressed fiberboard scarp into a container;

intimately contacting the scrap in the container with steam; and screening the steam-contacted scrap to separate the wood fibers from the scrap.

2. The method of claim 1, further comprising:

agitating the scrap in the container during said step of intimately contacting the scrap with steam.

3. The method of claim 1, said strip of intimately contacting the scrap comprising:

subjecting the scrap to steam at a pressure of greater than 1 p.s.i. above atmospheric pressure for a period of time of greater than 30 minutes.

4. The method of claim 3, said step of subjecting the scrap to steam comprising:

subjecting the scrap to steam at a pressure between 3 p.s.i. and 10 p.s.i. above atmospheric pressure.

5. The method of claim 1, further comprising:

withdrawing water from said container.

6. The method of claim 1, further comprising:

subjecting the scrap in said container to a pressure of less than atmospheric subsequent to said step of intimately contacting the scrap with steam.

7. The method of claim 6, further comprising:

agitating the scrap during said step of subjecting the scrap in said container to a pressure of less than atmospheric.

8. The method of claim 6, said pressure of less than atmospheric being less than 1 p.s.i. below atmospheric pressure.

9. The method of claim 8, said pressure of less than atmospheric being between 3 p.s.i. and 10 p.s.i. below atmospheric pressure.

10. The method of claim 1, further comprising:

transferring the steam-contacted scrap from said container to a screening device prior to said step of screening.

11. The method of claim 10, said screening device being a rotary trommel.

* * * * *